US010941478B2

(12) United States Patent
Schwarz et al.

(10) Patent No.: US 10,941,478 B2
(45) Date of Patent: Mar. 9, 2021

(54) ARC WIRE SPRAYING METHOD, EQUIPMENT AND PRODUCT

(71) Applicant: BMW Brilliance Automotive Ltd., Shenyang (CN)

(72) Inventors: Franz Schwarz, Viecht (DE); Stefan Wagner, Landshut (DE); Jingyuan Du, Shenyang (CN)

(73) Assignee: BMW Brilliance Automotive Ltd., Shenyang (CN)

( * ) Notice: Subject to any disclaimer, the term of this patent is extended or adjusted under 35 U.S.C. 154(b) by 54 days.

(21) Appl. No.: 16/611,364

(22) PCT Filed: Jun. 20, 2017

(86) PCT No.: PCT/CN2017/089097
§ 371 (c)(1),
(2) Date: Nov. 6, 2019

(87) PCT Pub. No.: WO2018/223419
PCT Pub. Date: Dec. 13, 2018

(65) Prior Publication Data

US 2020/0140986 A1 May 7, 2020

(30) Foreign Application Priority Data

Jun. 9, 2017 (CN) ..... 201710429633.8

(51) Int. Cl.
*C23C 4/131* (2016.01)
*B05B 7/22* (2006.01)

(52) U.S. Cl.
CPC ..... *C23C 4/131* (2016.01); *B05B 7/224* (2013.01)

(58) Field of Classification Search
CPC ..... B05B 7/22; B05B 7/222; B05B 7/224; C23C 4/131; C23C 4/14; C23C 4/16
See application file for complete search history.

(56) References Cited

U.S. PATENT DOCUMENTS 5,245,153 A 9/1993 Singer et al.
2004/0001966 A1* 1/2004 Subramanian ..... C23C 4/16 428/679

(Continued)

FOREIGN PATENT DOCUMENTS

CN 101418426 A 4/2009
CN 104053810 A 9/2014

(Continued)

*Primary Examiner* — Dah-Wei D. Yuan
*Assistant Examiner* — Nga Leung V Law
(74) *Attorney, Agent, or Firm* — The Webb Law Firm

(57) ABSTRACT

An arc wire spraying method includes conveying at least two wires out of respective lance nozzles of a wire conveying device by means of the wire conveying device, applying current to the two wires to form an arc for melting the ends of the two wires, and applying airflow to the arc in the direction transverse to the longitudinal direction of the wire conveying device by means of an airflow applying device so as to spray the melted wire material toward a surface to be sprayed. The airflow applying device rotationally applies the airflow around the longitudinal direction of the wire conveying device. Parameters for spraying are variably adjusted along the rotating direction of the airflow applying device. The airflow is rotationally applied at a varying rotating speed.

11 Claims, 4 Drawing Sheets

(56) References Cited

U.S. PATENT DOCUMENTS

| | | | | |
|---|---|---|---|---|
| 2004/0231596 | A1* | 11/2004 | George | C23C 4/16<br>118/722 |
| 2005/0186355 | A1* | 8/2005 | Miyamoto | C23C 4/131<br>427/446 |
| 2009/0104348 | A1* | 4/2009 | Terada | B05B 7/224<br>427/236 |
| 2012/0067285 | A1* | 3/2012 | Kodama | C23C 4/131<br>118/723 HC |
| 2014/0178594 | A1* | 6/2014 | Kobayashi | H01G 11/50<br>427/455 |
| 2014/0186540 | A1 | 7/2014 | Schramm et al. | |
| 2016/0273477 | A1* | 9/2016 | Schramm | C23C 4/134 |

FOREIGN PATENT DOCUMENTS

| | | | |
|---|---|---|---|
| CN | 107164715 | A | 9/2017 |
| EP | 1936003 | A2 | 6/2008 |
| FR | 2865218 | A1 | 7/2005 |
| JP | 2010235961 | A | 10/2010 |
| WO | 9008203 | A2 | 7/1990 |
| WO | 2018223419 | A1 | 12/2018 |

* cited by examiner

ARC WIRE SPRAYING METHOD, EQUIPMENT AND PRODUCT

CROSS-REFERENCE TO RELATED APPLICATIONS

This application is the United States national phase of International Application No. PCT/CN2017/089097 filed Jun. 20, 2017, and claims priority to Chinese Patent Application No. 201710429633.8 filed Jun. 9, 2017, the disclosures of which are hereby incorporated by reference in their entirety.

BACKGROUND OF THE INVENTION

Field of the Invention

The present disclosure relates to an arc wire spraying method. Besides, the present disclosure relates to arc wire spraying equipment. The present disclosure further relates to an arc wire sprayed product.

Background of the Invention

The arc wire spraying technology relates to a technology of melting a metal by means of arc as a heat source produced between two metal wires fed continuously, atomizing the melted metal with compressed air and spraying the atomized metal particles to a workpiece to form a coating. This technology is applied to a crankcase of an internal combustion engine of a motor vehicle nowadays, so that the metal particles form a thin layer on a cylinder working face. Thus, friction and wear in the internal combustion engine are remarkably reduced, besides, the technical effect of reducing space and weight is achieved by saving a traditional cylinder sleeve, and this technology is more beneficial to conducting heat out of a combustion chamber relative to the cylinder sleeve, thus facilitating efficient cooling.

In the existing arc wire spraying technology, particularly, under the condition that the inner surface of a cylindrical cavity, e.g., the cylinder working face of a crankcase, is sprayed, the whole arc wire spraying equipment needs to rotate in the cylindrical cavity so as to form a coating on the inner circumference thereof. However, it is disadvantageous that wire conveying devices need to rotate together and thereby resulting a complex and heavy structure. For example, as shown in DE 198 41 617 A1, a feeding device for conveying coat wire and an burner rod for arc spraying are arranged on a supporting device in a rotatable manner, and the feeding device rotates together with the burner rod, wherein a wire winch also needs to be arranged in the feeding device. In this published document, as the space for accommodating the wire winch is limited, and the wire winch often needs to be replaced in the production process, long-time continuous spraying is difficult to realize.

However, in the device and the method, whose wire conveying device does not rotate with the airflow applying device, it is discovered by research that a phenomenon that the coating is not uniform may be produced when the inner surface of a cylindrical cavity is sprayed by adopting the arc wire spraying method and equipment above, namely, the inner edge of the coating is not round, but approximately elliptic to a certain extent. In other words, the coating has different thicknesses on the inner circumference of the cylindrical cavity: with two thinner positions and two thicker positions, wherein the connecting line of the thinner positions is perpendicular to the connecting line of the thicker positions. It can be known from an experiment of manufacturing a cylinder working face by arc wire spraying that the diameter difference between the thinnest position and the thickest position is 0.2 mm to 0.3 mm. Such tolerance may result in problems which cannot be neglected in later honing and even in the operation of an internal combustion engine.

When the coating is used as a cylinder working face of a crankcase of an internal combustion engine of a motor vehicle, the following problems will occur.

Firstly, the thicker positions of the coating are unbeneficial to conducting heat out of a combustion chamber. This leads to partial overheating in the crankcase, which is unbeneficial to the operation of the internal combustion engine. Generally, the thicker positions of the arc wire coating become blue due to overheating.

Secondly, the coating at the thinner positions may produce pore nests, whereas the coating at the thicker positions even sheds after honing. In the present disclosure, the pore nests refer to that the sprayed metal particles do not form a compact structure on the inner surface of the cylindrical cavity, but a plurality of holes or a porous structure exist between them. Such pore nests may aggravate partial corrosion in the operation of the internal combustion engine, which is unbeneficial to prolonging the service life of the internal combustion engine. Besides, the pore nests may also hinder partial heat transfer, and are unbeneficial to heat conduction and cooling herein. The peel off refers to peeling of the small-area coating in the honing process, and the corresponding area in the original coating is sunken and even lost. The peel off in the honing process directly results in discarding the workpiece, as the whole coating is difficult to remove. This will cause cost increase and material waste for large-batch production.

Thirdly, non-uniform thickness may also lead to non-uniform tension of the coating. When the non-uniform tension is released in the operating process of the internal combustion engine, further plastic deformation of the coasting may be caused. When the deformation reaches a certain degree, the operating performance of the internal combustion engine may be degraded and even the whole coating may be damaged.

Finally, as the coating has non-uniform thickness, the thickness distribution needs to be detected previously in next honing so as to determine the honing removal quantity of each position. As more coating materials need to be removed at the thicker positions, the consumption of a honing tool is accelerated, so that the service life of the honing tool is shortened and the machining cost is high. Besides, real-time monitoring is also needed in the honing process. This undoubtedly leads to waste of time cost.

SUMMARY OF THE INVENTION

The task of the present disclosure is to provide a relative to the prior art improved arc wire spraying method and equipment as well as a corresponding arc wire sprayed product manufactured by the equipment according to the present disclosure in accordance with the method of the present disclosure, which overcome the above mentioned defects in the prior art and can realize a relatively uniform coating thickness at each position of the circumference.

In terms of the method, the task is solved by an arc wire spraying method of the present disclosure: conveying at least two wires out of respective lance nozzles of a wire conveying device by means of the wire conveying device, applying current to the at least two wires to form an arc for melting the ends of the at least two wires, and applying airflow to the arc in the direction approximately transverse to the longitudinal direction of the wire conveying device by means of an airflow applying device so as to spray the melted wire material toward a surface to be sprayed, wherein the airflow applying device rotationally applies the airflow around the longitudinal direction of the wire conveying device, wherein parameters for spraying are variably adjusted along the rotating direction of the airflow applying device.

In terms of equipment, the task is solved by arc wire spraying equipment of the present disclosure: the equipment comprises a wire conveying device and an airflow applying device, wherein the wire conveying device comprises a current charger and at least two lance nozzles, the wire conveying device conveys at least two wires out of the respective lance nozzles, current is applied to the at least two wires by the current charger to form an arc in the region of the lance nozzles so that the ends of the at least two wires are melted, and airflow is applied to the arc in the direction approximately transverse to the longitudinal direction of the wire conveying device by the airflow applying device so as to spray the melted wire material toward a surface to be sprayed, wherein the airflow applying device can rotationally apply the airflow around the longitudinal direction of the wire conveying device, wherein parameters for spraying are variably adjusted along the rotating direction of the airflow applying device.

In the present disclosure, on one hand, the airflow applying device rotates around the longitudinal direction of the wire conveying device, so that the wire conveying device does not need to rotate together. In other words, the wire conveying device can lie in a position which is fix relative to the airflow applying device. By means of the technical solution, a mechanism enabling the wire conveying device to rotate can be saved, so that a flexible and simplified overall structure is realized. Meanwhile, space and energy enabling a heavy wire winch to rotate together are also saved. Besides, the wire winch does not need to be replaced frequently, so that the manpower cost and the time cost are reduced.

On the other hand, parameters for spraying are variably adjusted along the rotating direction of the airflow applying device. According to the present disclosure, the expression "parameters for spraying are variably adjusted along the rotating direction" means that the parameters for spraying is adjusted non-constantly along the rotating direction, that is to say, the parameters for spraying are varying along the rotating direction. However, the variation herein is not limited to continuous variation, but may be step variation. The variation may be defined by a function, and may also be expressed in the form of a progression or a lookup table.

As for the above problems in the prior art, the present disclosure puts forward variably adjusting the parameters for spraying along the rotating direction of the airflow applying device. In the present disclosure, the parameters for spraying include rotating speed and air flow rate of the airflow applying device and current of the current charger. The rotating speed of the airflow applying device is the speed of the airflow applying device rotating around the wire conveying device, and can be represented as linear speed or angular speed. The air flow rate of the airflow applying device is the air flow in unit time. The current of the current charger refers to the current intensity applied to wires for spraying.

By variably adjusting said parameters along the rotating direction of the airflow applying device, the spraying process can be variably implemented in each angle direction of rotation. As a result, more wires can be sprayed to the original thin positions and less wire material can be sprayed to the original thick positions as mentioned above, so that the circumferential surface of the whole coating has uniform thickness. Thus, the problem that the thickness of the coating is not uniform is remarkably solved according to the embodiment of the present disclosure. It can be known from an experiment of manufacturing a cylinder working face by arc wire spraying that the diameter difference between the thinnest position and the thickest position is reduced to 0.08 mm. Based on the improved thickness uniformity, the problems mentioned above can be solved when the cylinder working face is manufactured via said embodiment. Firstly, the uniform thickness of the coating is beneficial to uniformly conducting heat out of the combustion chamber, thus avoiding partial overheating. Secondly, pore nests which may appear in the coating and peel off are reduced and even avoided. It can be known according to experiments that the probability of pore nests and peel off can be reduced to 0%. This avoids corrosion, so that the service life of the internal combustion engine is prolonged. Meanwhile, the rejection rate is also greatly reduced in the production process, so that the manufacturing cost is reduced and material waste is avoided. Besides, the uniform thickness distribution correspondingly results in uniform coating tension on the whole circumference, thus avoiding deformation of the coating in the operating process of the internal combustion engine, and prolonging the service lives of the coating and the whole internal combustion engine. In addition, as the thickness of the coating is relatively uniform at each position of the circumference, the thickness distribution does not need to be detected previously in honing and real-time monitoring of the honing process is also saved, so that the honing step is simplified. The service life of the honing tool is prolonged, and the machining cost is reduced. According to one embodiment of the method of the present disclosure, airflow can be rotationally applied at a varying rotating speed. Correspondingly, according to one embodiment of the equipment of the present disclosure, the airflow applying device can rotate at a varying rotating speed.

According to one embodiment of the method of the present disclosure, airflow can be applied at a varying air flow rate. Correspondingly, according to one embodiment of the equipment of the present disclosure, the airflow applying device can apply the airflow at a varying air flow rate.

According to one embodiment of the method of the present disclosure, the wires can be applied with varying current. Correspondingly, according to one embodiment of the equipment of the present disclosure, the current charger can apply the wires with varying current.

Thus, corresponding adjustors can be arranged to realize the above variations. For example, the airflow applying device of the present disclosure can rotate by means of a motor. Thus, a motor adjustor can be arranged to control the motor to run at varying power, so that the airflow applying device rotates at a varying rotating speed. Besides, a device for adjusting the air flow rate or the air flow rate in unit time can be arranged at the upper reaches of the airflow applying device or in the airflow applying device, so that the airflow applying device can apply the airflow at a varying air flow rate. In addition, a device for adjusting current can be arranged at the upper reaches of the current charger or in the current charger, so that the current charger can apply the wires with varying current.

Researches show that the phenomenon that the coating is not uniform when the inner surface of the cylindrical surface is sprayed as mentioned above is related to the positions of the lance nozzles. The thickness distribution of the coating is often approximately elliptic. The ellipse has a long axis and a short axis perpendicular to each other. The short axis points to the thinner positions of the coating, while the long axis points to the thicker positions of the coating. Under the condition that the wire conveying device is provided with two or more lance nozzles arranged along a straight line, a thick coating is always produced in the direction of the connecting line of the lance nozzles. In other words, the long axis of the ellipse is almost superposed with the connecting line of the lance nozzles. In combination with the rotating trajectory of the airflow applying device, the thicker positions correspond to the intersection positions of the rotating trajectory of the wire conveying device and the straight line of the lance nozzles. The thin coating is produced at the positions of rotating 90° relative to the thicker positions or at the positions where the tangents of the rotating trajectory of the airflow applying device are parallel to the straight line. The short axis where the thin coating is located is perpendicular to the connecting line of the lance nozzles and passes through the midpoint of the long axis of the ellipse. Supposedly, the cause of the phenomenon is related to the spatial position distribution of the arc to a certain degree, and is further related to the arrangement of the lance nozzles of the wire conveying device. In combination with the rotating trajectory of the airflow applying device, the thinner positions correspond to the positions where the tangents of the rotating trajectory of the airflow applying device are parallel to the straight line.

Based on the above discovery, the present disclosure further puts forward variably adjusting the parameters for spraying along the rotating direction of the airflow applying device, so that more wire material is sprayed at the original thin positions of the coating, less wire material is sprayed at the original thick positions of the coating, and a coating having uniform thickness on the whole circumference is produced.

According to one embodiment of the present disclosure, under the condition that the lance nozzles are arranged in a straight line, the rotating speed of the airflow applying device at the positions where its rotating trajectory is crossed with the straight line is higher than that at the positions where the tangents of the rotating trajectory are parallel to the straight line.

Through the embodiment, the airflow applying device can quickly pass through the positions where its rotating trajectory is crossed with the straight line, and the positions just correspond to the original thick positions of the coating, so that the airflow applying device sweeps over the original thick positions quickly, and less wire material is sprayed toward the surface. The thickness of the coating is finally uniform, so that the above problems caused by non-uniform thickness are solved.

According to one preferred embodiment of the present disclosure, the rotating speed of the airflow applying device at the positions where its rotating trajectory is crossed with the straight line may be 10%, 20%, 30%, 40%, 50% 60% or higher than that at the positions where the tangents of the rotating trajectory are parallel to the straight line. It should be noted that the present disclosure is not limited to the values. Any value over 10% not limited to integers can also be available.

According to one embodiment of the present disclosure, the rotating speed is increased when the positions are approached where the rotating trajectory is crossed with the straight line, but decreased when the positions are approached where the tangents of the rotating trajectory are parallel to the straight line. A more uniform coating can be realized through this embodiment. The airflow applying device can quickly pass through the positions where its rotating trajectory is crossed with the straight line, i.e., original thick positions of the coating, and the airflow applying device quickly sweeps over the original thick positions, so that less wire material is sprayed toward the surface. Additionally, the airflow applying device can slowly pass through the positions where the tangents of its rotating trajectory are parallel to the straight line, i.e., the original thin positions of the coating, and the airflow applying device slowly passes through the original thick positions, so that more wire material is sprayed toward the surface. Further uniform thickness of the coating is finally realized.

According to one embodiment of the present disclosure, the rotating speed is continuously varied. Through the embodiment, the thickness uniformity of the coating can be further improved, as the original non-uniform thickness is approximately continuously varied. In this case, the rotating speed can be specifically adjusted along the rotating direction of the airflow applying device.

According to one embodiment of the present disclosure, the rotating speed is selected according to the angle between the airflow and the plane of the rotating trajectory. According to the present disclosure, the airflow is applied to the arc by means of the airflow applying device in the direction approximately transverse to the longitudinal direction of the wire conveying device. Herein, applying the airflow in the direction approximately transverse to the longitudinal direction of the wire conveying device means that the applied airflow can be perpendicular to the longitudinal direction of the wire conveying device, or can be approximately perpendicular to the wire conveying device in a manner of deviating for a certain angle (e.g., less than 300). In other words, the airflow and the plane of the rotating trajectory can form a certain angle. Thus, the rotating speed, particularly the varying rotating angle, is selected according to the angle between the airflow and the plane of the rotating trajectory. The maximum, minimum, intermediate value and the like of the rotating speed can be set according to the angle between the airflow and the plane of the rotating trajectory. The varying curve, varying function, value list or the like of the rotating speed can also be set according to the angle.

According to another embodiment of the present disclosure, under the condition that the lance nozzles are arranged in a straight line, the air flow rate of the airflow applying device at the positions where its rotating trajectory is crossed with the straight line is lower than that at the positions where the tangents of the rotating trajectory are parallel to the straight line.

As elaborated above, the original thick positions of the coating correspond to the positions where the rotating trajectory of the wire conveying device is crossed with the straight line of the lance nozzles. In order to overcome the defect, it could be considered to apply weak airflow (i.e., having low air flow rate) to the original thick positions of the coating, so that less wire material is sprayed to the inner surface at the positions. Similarly, it may also be considered that the air flow rate is decreased when the positions are approached where the rotating trajectory is crossed with the straight line, but increased when the positions are approached where the tangents of the rotating trajectory are parallel to the straight line. Preferably, the air flow rate can be continuously varied.

According to a further embodiment of the present disclosure, under the condition that the lance nozzles are arranged in a straight line, the current applied by the current charger when the airflow applying device passes through the positions where the rotating trajectory is crossed with the straight line is lower than the current applied when the airflow applying device passes through the positions where the tangents of the rotating trajectory are parallel to the straight line.

In order to make thickness of the coating uniform, the current charger applies low current when the airflow applying device passes through the positions where the rotating trajectory is crossed with the straight line, so that the energy for melting the wires is low, less wire material is melted at said positions, and less wire material is sprayed onto the inner surface by the airflow applying device. Similarly, it may also be considered that the current is decreased when the positions are approached where the rotating trajectory is crossed with the straight line, but is increased when the positions are approached where the tangents of the rotating trajectory are parallel to the straight line. Preferably, the current can be continuously varied.

According to one embodiment of the present disclosure, additional airflow is applied in the longitudinal direction of the wire conveying device. In terms of the equipment of the present disclosure, at least one additional nozzle is arranged between the at least two lance nozzles to apply the additional airflow in the longitudinal direction of the wire conveying device. The wires melted by the arc can be atomized better by such embodiment. This is beneficial to improving the quality of the coating.

According to one embodiment of the present disclosure, the arc wire spraying method and equipment can be used for spraying the inner surface of a cylindrical cavity.

According to one embodiment of the present disclosure, the inner surface of the cylindrical cavity is a cylinder working face of a crankcase.

In terms of a product, the present disclosure relates to an arc wire sprayed product, and the product is manufactured by the equipment according to the present disclosure in accordance with the method according to the present disclosure.

However, each feature of the present disclosure is not limited to each embodiment, but can be combined with said additional features and/or each feature of other embodiments. Details in the accompanying drawings are merely interpretive, but not restrictive. The drawing signs included in the claims shall not limit the protection scope of the present disclosure in any manner, but only indicate the embodiments shown in the drawings.

DETAILED DESCRIPTION OF THE EMBODIMENTS

Figure 1:
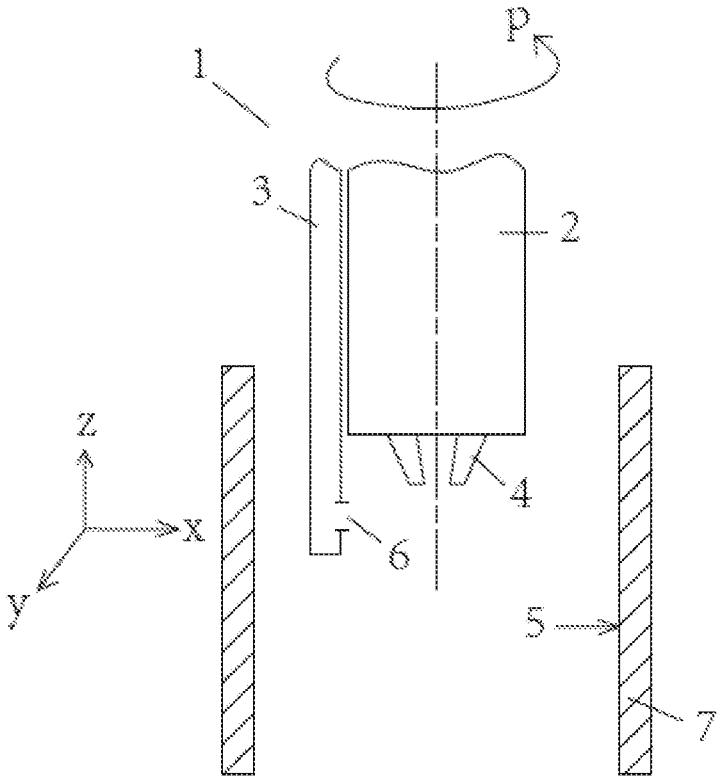
FIG. 1 shows a schematic side view of arc wire spraying equipment of the present disclosure.

Different embodiments are now described in detail with reference to the accompanying drawings, wherein some embodiments are shown in the drawings. For the sake of clearness, the widths of lines and/or areas can be exaggeratedly shown in the drawings.

In the accompanying drawings, same or mutually corresponding elements are respectively indicated by the same drawing signs. The elements described by the same drawing signs can be implemented equally or differently if necessary on single, multiple or all features (e.g., their dimensions). The disclosure contents included in the whole description can be diverted to the same parts having the same drawing signs or the same component signs according to the meanings. The positions selected in the description, e.g., upper, lower, left, right, side and the like, refer to the directly described and shown drawings and are diverted to new positions according to the meanings when the positions are changed. Besides, a single feature or a feature combination in different embodiments shown and described can also constitute a creative solution per se.

Although each embodiment can be modified in multiple modes, the embodiment in each drawing is shown as an example and described in detail therein. However, it shall be clear that each embodiment is unintentionally limited to the corresponding disclosed form, and more exactly speaking, each embodiment shall cover all functional and/or structural modified solutions, equivalent solutions and alternative solutions in the scope of the present disclosure.

FIG. 1 shows a schematic side view of arc wire spraying equipment of the present disclosure. The arc wire spraying equipment 1 herein includes a wire conveying device 2 and an airflow applying device 3. The wire conveying device 2 includes a current charger not shown and at least two lance nozzles 4. The wire conveying device 2 conveys at least two wires out of the respective lance nozzles 4. Current is applied to the at least two wires by the current charger not shown to form an arc in the region of the lance nozzles, so that the ends of the at least two wires are melted. Airflow is applied to the arc in the direction approximately transverse to the longitudinal direction z of the wire conveying device 2 by the airflow applying device 3 so as to spray the melted wire material toward a surface 5 to be sprayed. According to the present disclosure, the airflow applying device 3 can rotationally apply the airflow around the longitudinal direction z of the wire conveying device 2, wherein parameters for spraying are variably adjusted along the rotating direction of the airflow applying device 3. Particularly, the wire conveying device 2 does not rotate herein, only the airflow applying device 3 rotates around it, and relative rotation is thus produced between them.

FIG. 1 schematically shows the wire conveying device 2. The wire conveying device is schematically a cylinder. As shown in the figure, the axis of the cylinder is defined as the longitudinal direction z of the wire conveying device 2. A pipeline not shown is integrated inside the wire conveying device 2 to convey wires. A device enabling wires to move is arranged upstream of the wire conveying device 2, or inside the wire, conveying device to continuously convey the wires in the spraying process. According to this embodiment, two lance nozzles 4 are arranged at the bottom of the wire conveying device 2, and the lance nozzles 4 are connected with the pipeline. The two lance nozzles 4 form hollow cones for conveying spraying wires therein.

The sharp ends of the cones approach each other, so that the wires conveyed out of the lance nozzles 4 approach each other. It should be noted that only two lance nozzles are shown in the drawings, but the present disclosure is not limited to the two lance nozzles, and the number of the lance nozzles may be two, three, four or more.

The wire conveying device includes a current charger not shown, and the current charger applies current to the at least two wires respectively. The current charger is connected with a current source not shown as well to provide energy for forming an arc between the wires. The at least two wires produce arc discharge in the region of the lance nozzles, so that the wires produce high temperature based on continual strong current and the ends of the wires are instantaneously melted.

FIG. 1 also schematically shows the airflow applying device 3. The airflow applying device 3 is shown as a cuboid schematically, and its longitudinal extending direction is parallel to the axis of the wire conveying device 2 or the longitudinal direction z. A pipeline for air flowing is integrated in the airflow applying device 3, and a nozzle is arranged on the side of the lower end as shown in the figure. The nozzle points to the region of the lance nozzles.

The airflow applying device 3 can rotate around the longitudinal direction z of the wire conveying device 2 in the direction shown by the arrow p in FIG. 1, so that the airflow applying device 3 can rotationally apply airflow to the arc, the melted wire material are atomized and the atomized wire particles are sprayed toward the surface to be sprayed. However, the present disclosure is not limited to the rotation direction showing in the Figures and the airflow applying device 3 can rotate in a clockwise direction or in a counterclockwise direction.

However, the airflow applying device of the present disclosure is not limited to such embodiment. A sleeve-type airflow applying device may also be considered. The sleeve-type airflow applying device also rotates around the longitudinal direction z of the wire conveying device 2, and thus rotationally applies airflow to the arc. The sleeve may be provided with a double-layer wall for air flowing, even the double-layer wall is saved, so that the outer wall of the wire conveying device is utilized to define the air flowing space. It should be noted that the nozzle 6 as shown in FIG. 1 is merely schematic. The nozzle 6 may be in a single-hole or multi-hole form. Various arrangement modes of holes can be considered in the multi-hole form to meet different spraying requirements. Particularly, different airflow directions can be realized via the nozzle, and reference may be made to the detailed description on FIG. 3 below.

An arc wire spraying method will be described by means of the accompanying drawings, too. The arc wire spraying method of the present disclosure includes the steps of conveying at least two wires out of respective lance nozzles 4 of the wire conveying device 2 by means of the wire conveying device 2, applying current to the at least two wires to form an arc for melting the ends of the at least two wires, and applying airflow to the arc in the direction approximately transverse to the longitudinal direction z of the wire conveying device 2 by means of the airflow applying device 3 so as to spray the melted wire material toward a surface to be sprayed, wherein the airflow applying device 3 rotationally applies the airflow around the longitudinal direction z of the wire conveying device 2, wherein parameters for spraying are variably adjusted along the rotating direction of the airflow applying device 3.

According to a preferred application of the present disclosure, the arc wire spraying method and equipment are used for spraying the inner surface of a cylindrical cavity. FIG. 1 schematically shows a section view of the cylindrical cavity 7, and the inner surface of the cylindrical cavity 7 is a surface 5 to be sprayed in the present disclosure. Particularly preferably, the inner surface of the cylindrical cavity is a cylinder working face of a crankcase.

When arc wires are sprayed to the inner surface of the cylindrical cavity, in order to spray different depth positions of the inner surface, the wire conveying device 2 and the airflow applying device 3 can jointly move downwards in the longitudinal direction z to plunge into the lower part of the cylindrical cavity. In the spraying process, the airflow applying device 3 continually rotates around the wire conveying device 2, and the wire conveying device 2 and the airflow applying device 3 simultaneously rise up to spray the whole inner surface of the cylindrical cavity from bottom to top. Needless to say, spraying from top to bottom may also be considered. Similarly, it could consider that the airflow applying device only rotates around the wire conveying device 2 without changing the height positions of the wire conveying device 2 and the airflow applying device 3. In this case, the height position of the cylindrical cavity can be changed, so that the cylindrical cavity moves from bottom to top or from top to bottom relative to the wire conveying device 2 and the airflow applying device 3.

In order to achieve the effect that the coating is relative uniform when the inner surface of the cylindrical cavity is sprayed, it is defined according to the present disclosure that parameters for spraying are variably adjusted along the rotating direction of the airflow applying device 3. Specifically, airflow can be rotationally applied at a varying rotating speed. Correspondingly, the airflow applying device 3 can rotate at the varying rotating speed. Besides, the airflow can be applied at a varying air flow rate. Correspondingly, the airflow applying device 3 can apply the airflow at the varying air flow rate. In addition, the wires can be applied with varying current. Correspondingly, the current charger can apply the wires with the varying current.

How to variably adjust the parameters for spraying will be described in more detail below by means of the position relationship shown in FIG. 2.

Figure 2:
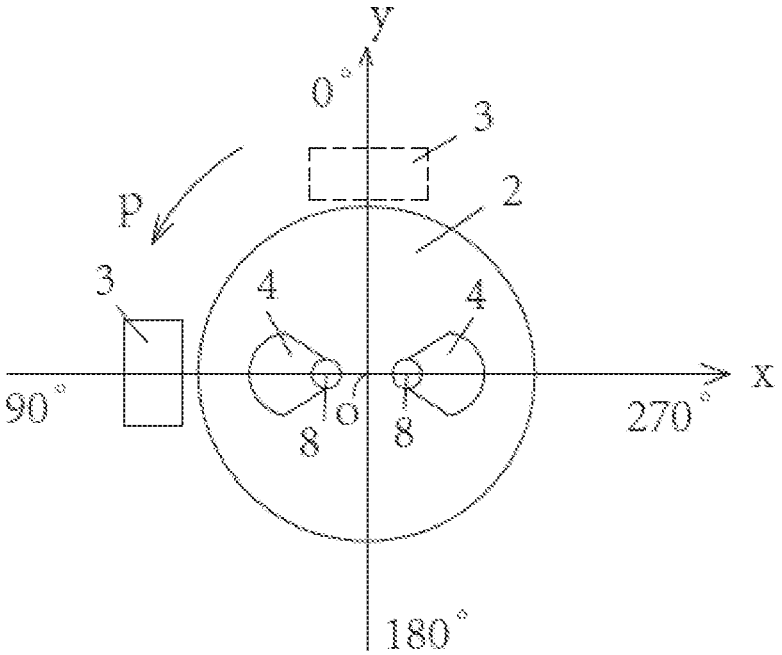
FIG. 2 shows a bottom view of the arc wire spraying equipment of the present disclosure.

FIG. 2 shows a bottom view of the arc wire spraying equipment 1 in FIG. 1. FIG. 2 shows the situation of the bottom view of the arc wire spraying equipment. According to the coordinate system shown in FIG. 1, an x axis and a y axis are added in FIG. 2 and angles are marked on the axes, in order to express the position relationship of all parts more clearly.

Two lance nozzles 4 are arranged at the bottom of the wire conveying device 2. In FIG. 2, the two lance nozzles 4 are arranged along a straight line or arranged horizontally along the x axis. At the bottoms of the two lance nozzles 4, two wires for spraying are respectively conveyed out of a hole 8 of the lance nozzle 4 and approach each other.

The airflow applying device 3 is arranged beside the wire conveying device 2. The airflow applying device 3 rotates around the origin O in the direction of arrow p shown in the figure. The z axis shown in FIG. 1 passes through the origin O.

FIG. 2 also shows one position of the airflow applying device 3 represented by a solid box, and this position is called a 0° position below. FIG. 2 shows one position of the airflow applying device 3 represented by a dashed box, and this position is called a 90° position below.

The airflow applying device 3 can rotate 90° from the position of the dashed box to the position of the solid box along the direction shown by the arrow p, can continuously rotate, passes through 180° and 270° positions, and finally returns to the 0° position. A rotating trajectory is formed when the airflow applying device 3 rotates, the rotating trajectory is a circle around the origin O, and the circle is also concentric with the wire conveying device 2.

It can be seen from FIG. 2 that the rotating trajectory of the airflow applying device 3 is crossed with the straight line of the lance nozzles or the x axis at the 90° and 270° positions. At 0° and 180° positions, the tangents of the rotating trajectory of the airflow applying device 3 are parallel to the straight line of the lance nozzles or the x axis.

As mentioned above, the phenomenon that the coating is not uniform when the inner surface of the cylindrical cavity is sprayed is related to the positions of the lance nozzles. The thicker positions of the coating correspond to the positions where the rotating trajectory of the airflow applying device is crossed with the straight line of the lance nozzles, i.e., 900 and 270° positions in FIG. 2. At the positions where the tangents of the rotating trajectory of the airflow applying device are parallel to the straight line of the lance nozzles, i.e., 0° and 180° positions shown in FIG. 2, a thin coating is produced. Upon such research conclusions, the present disclosure puts forward variably adjusting parameters for spraying along the rotating direction of the airflow applying device, so that more wire material is sprayed at the original thin (0° and 180°) positions of the coating, less wire material is sprayed at the original thick (90° and 270°) positions of the coating, and a coating having uniform thickness on the whole circumference is produced. Specifically, a straight line (represented as x axis in FIG. 2) can be prescribed through the lance nozzles 4, and the rotating speed of the airflow applying device 3 at the positions (90° and 270° positions) where its rotating trajectory is crossed with the straight line may be higher than that at the positions (0° and 180° positions) where the tangents of the rotating trajectory are parallel to the straight line. Besides, the air flow rate of the airflow applying device 3 at the positions (90° and 270° positions) where its rotating trajectory is crossed with the straight line may be lower than that at the positions (0° and 180° positions) where the tangents of the rotating trajectory are parallel to the straight line. In addition, the current applied by the current charger when the airflow applying device 3 passes through the positions (90° and 270° positions) where the rotating trajectory is crossed with the straight line can be lower than the current applied when the airflow applying device 3 passes through the positions (0° and 180° positions) where the tangents of the rotating trajectory are parallel to the straight line. Through the above three modes, more wires can sprayed at the original thin positions of the coating, less wire material is sprayed at the original thick positions of the coating, and a coating having uniform thickness on the whole circumference is thus produced.

In order to realize more uniform thickness, it may also be considered that the rotating speed is increased when the positions are approached where the rotating trajectory is crossed with the straight line, but decreased when the positions are approached where the tangents of the rotating trajectory are parallel to the straight line. Referring to FIG. 2, the rotating speed of the airflow applying device 3 is decreased when the 0° and 180° positions are approached, but increased when the 90° and 270° positions are approached in the rotating process. In other words, in the coordinate system shown in FIG. 2, when the airflow applying device rotates anticlockwise, the rotating speed of the airflow applying device 3 is decreased in the first quadrant and the third quadrant, but increased in the second quadrant and the fourth quadrant. Particularly preferably, the rotating speed is continuously varied.

Figure 3:
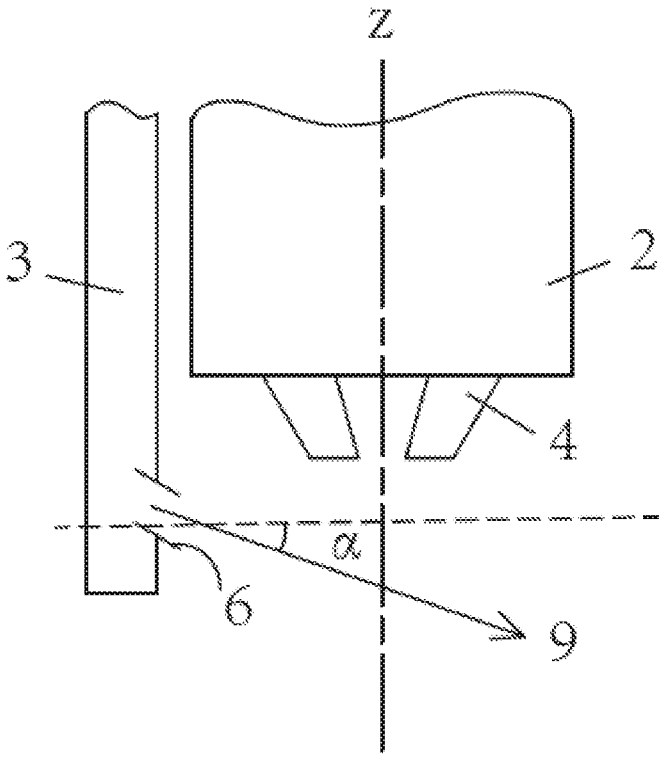
FIG. 3 shows a detail view of the arc wire spraying equipment of the present disclosure.

FIG. 3 shows a detail view of the arc wire spraying equipment of the present disclosure. Particularly shown herein is airflow 9 jet from the nozzle 6 of the airflow applying device 3. A fluid director of the nozzle 6 is also schematically shown herein, and the jet direction of the airflow 9 can be defined under the action of the fluid director. FIG. 3 additionally shows a rotating plane of the airflow applying device 3 with a dotted line, i.e., a plane defined by the airflow applying device 3. The airflow 9 forms an angle $\alpha$ relative to the rotating plane. According to the present disclosure, the rotating speed of the airflow applying device 3, particularly the varying rotating speed, can be selected according to the angle $\alpha$ between the airflow 9 and the plane of the rotating trajectory. Thus, the maximum, minimum, intermediate value and the like of the rotating speed can be set according to the angle $\alpha$ between the airflow 9 and the plane of the rotating trajectory. The varying curve, varying function, value list or the like of the rotating speed can also be set according to the angle. Thus, a coating having uniform thickness can be realized particularly well.

Figure 4A:
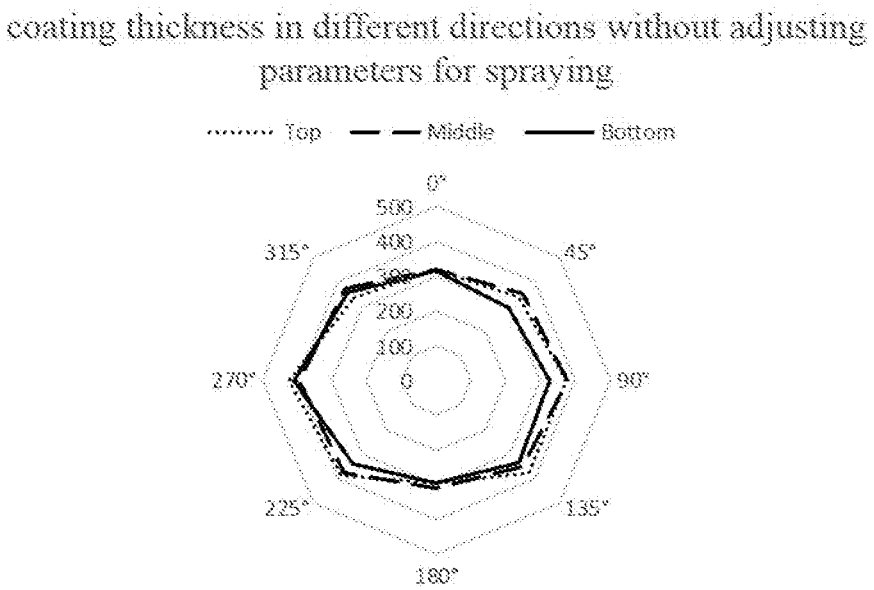
FIG. 4*a* shows a polar coordinate diagram of coating thickness distribution generated without adjusting parameters for spraying.
Figure 4B:
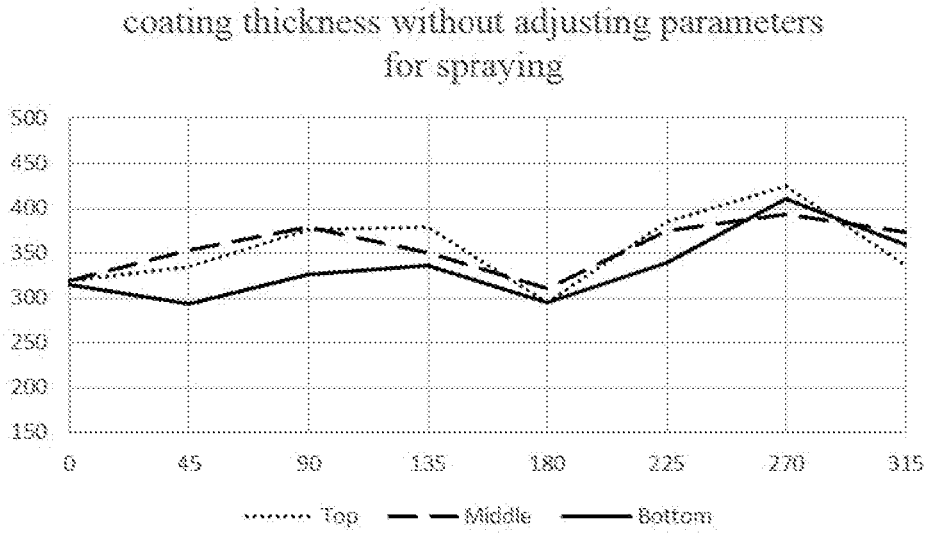
FIG. 4*b* shows a curve diagram of coating thickness distribution generated without adjusting parameters for spraying.

FIG. 4*a* and FIG. 4*b* show a polar coordinate diagram and a curve diagram of coating thickness distribution generated without adjusting parameters for spraying in the prior art, respectively, wherein three different lines represent a schematic diagram of coating thickness measured on the inner surface of the top, middle and bottom part of the sprayed cylindrical cavity. In the diagrams, the dotted line represents the thickness result of the top part of the cylindrical cavity, the dashed line represents the thickness result of the middle part of the cylindrical cavity, and the solid line represents the thickness result of the bottom part of the cylindrical cavity. FIG. 4*a* shows a polar coordinate diagram of thickness distribution, and FIG. 4*b* shows a curve diagram of thickness in each angle direction. It can be clearly seen that the thickness fluctuates drastically within the angle range of the circumference under the condition that the parameters for spraying are constant.

Two thin positions and two thick positions are produced on the whole circumference. The polar coordinate diagram in FIG. 4*a* clearly shows that the thickness distribution on the whole circumference is elliptic, thick positions appear at 90° and 270°, and thin positions appear at 0° and 180°. The angles shown in FIG. 4*a* to FIG. 5*b* also correspond to the angles shown in FIG. 2. In other words, when the inner surface of the cylindrical cavity is sprayed by the arc wire spraying equipment 1 in FIG. 2, the thickness corresponding to FIG. 4*a* to FIG. 5*b* will appear in each angle direction shown in FIG. 2.

Figure 5A:
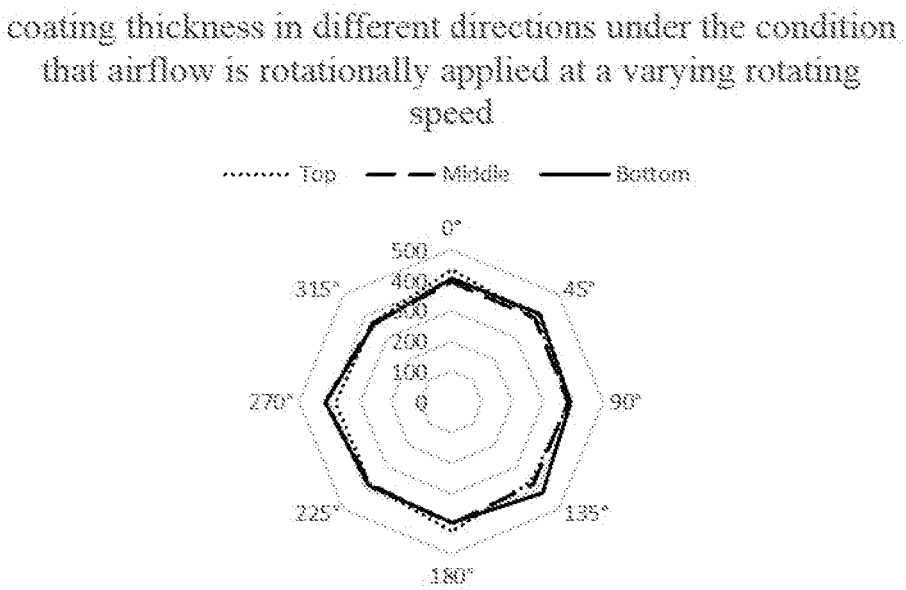
FIG. 5*a* shows a polar coordinate diagram of coating thickness distribution generated under the condition that airflow is rotationally applied at a varying rotating speed.
Figure 5B:
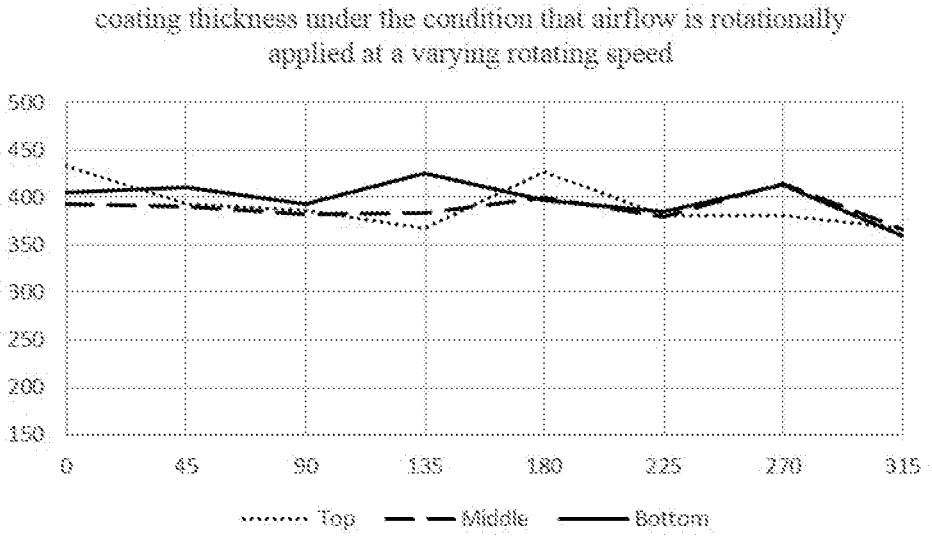
FIG. 5*b* shows a curve diagram of coating thickness generated under the condition that airflow is rotationally applied at a varying rotating speed.

FIG. 5*a* and FIG. 5*b* show a polar coordinate diagram and a curve diagram of coating thickness distribution generated under the condition that airflow is rotationally applied at a varying rotating speed according to the present disclosure, respectively. FIG. 5*a* and FIG. 5*b* adopt the same signs as FIG. 4*a* and FIG. 4*b*. FIG. 5*a* and FIG. 5*b* particularly show a result of thickness generated by applying the following embodiment, i.e., the rotating speed of the airflow applying device 3 at the positions (90° and 270° positions) where its rotating trajectory is crossed with the straight line may be higher than that at the positions (0° and 180° positions) where the tangents of the rotating trajectory are parallel to the straight line.

It can be obviously seen from the curve diagram in FIG. 5*b* that the coating thickness no longer fluctuates drastically on the whole circumference, but falls into a certain tolerance range of about 400 μm. Such thickness shows that a rough circle can be seen from the polar coordinate diagram in FIG. 5*a*. Accordingly, uniform coating thickness can be realized via the present disclosure, and the problems caused by non-uniform thickness as mentioned above can be solved.

The invention claimed is:

1. An arc wire spraying method, comprising the following steps:

conveying at least two wires out of respective lance nozzles of a wire conveying device by means of the wire conveying device, applying current to the at least two wires to form an arc for melting the ends of the at least two wires, and applying airflow to the arc in the direction transverse to the longitudinal direction of the wire conveying device by means of an airflow applying device so as to spray the melted wire material toward a surface to be sprayed, wherein the airflow applying device rotationally applies the airflow around the longitudinal direction of the wire conveying device, wherein parameters for spraying are variably adjusted along the rotating direction of the airflow applying device, wherein the airflow is rotationally applied at a varying rotating speed, wherein the lance nozzles are arranged in a straight line, wherein the rotating speed of the airflow applying device at the positions where its rotating trajectory is crossed with the straight line is higher than that at the positions where the tangents of the rotating trajectory are parallel to the straight line.

2. The arc wire spraying method of claim 1, wherein the rotating speed is increased when the positions are approached where the rotating trajectory is crossed with the straight line, but decreased when the positions are approached where the tangents of the rotating trajectory are parallel to the straight line.

3. The arc wire spraying method of claim 2, wherein the rotating speed is continuously varied.

4. The arc wire spraying method of claim 1, wherein the rotating speed is selected according to the angle between the airflow and the plane of the rotating trajectory.

5. The arc wire spraying method of claim 1, wherein the airflow is applied at a varying air flow rate.

6. The arc wire spraying method of claim 5, wherein the air flow rate of the airflow applying device at the positions where its rotating trajectory is crossed with the straight line is lower than that at the positions where the tangents of the rotating trajectory are parallel to the straight line.

7. The arc wire spraying method of claim 1, wherein the wires are applied with varying current.

8. The arc wire spraying method of claim 7, wherein the current applied by a current charger when the airflow applying device passes through the positions where the rotating trajectory is crossed with the straight line is lower than the current applied when the airflow applying device passes through the positions where the tangents of the rotating trajectory are parallel to the straight line.

9. The arc wire spraying method of claim 1, wherein additional airflow is applied in the longitudinal direction of the wire conveying device.

10. The arc wire spraying method of claim 1, wherein the arc wire spraying method is used for spraying the inner surface of a cylindrical cavity.

11. The arc wire spraying method of claim 10, wherein the inner surface of the cylindrical cavity is a cylinder working face of a crankcase.

* * * * *